United States Patent [19]

Svensson

[11] 4,410,996

[45] Oct. 18, 1983

[54] MELT REDUCTION ARC FURNACE

[75] Inventor: Rune Svensson, Surahammar, Sweden

[73] Assignee: ASEA AB, Vasteras, Sweden

[21] Appl. No.: 268,176

[22] Filed: May 29, 1981

[30] Foreign Application Priority Data

May 29, 1980 [SE] Sweden ..... 8003992
May 29, 1980 [SE] Sweden ..... 8003993

[51] Int. Cl.[3] ..... F27D 7/00

[52] U.S. Cl. ..... 373/9; 373/73; 373/82

[58] Field of Search ..... 373/8, 9, 73, 74, 81, 373/82

[56] References Cited

U.S. PATENT DOCUMENTS 3,129,274 4/1964 Lindblom et al. ..... 373/81 X
4,146,390 3/1979 Widell ..... 373/82 X

*Primary Examiner*—Roy N. Envall, Jr.
*Attorney, Agent, or Firm*—Kenyon & Kenyon

[57] ABSTRACT

A melt reduction furnace has a flat gas-tight roof through which the oxide feeding electrode projects an extent less than usual inside the furnace to reduce its breakage risk, and a side wall gas exhaust opening above an upstanding threshold providing low-velocity gas exhaust while the threshold holds back gas flow with possible dust below the opening.

6 Claims, 2 Drawing Figures

MELT REDUCTION ARC FURNACE

BACKGROUND OF THE INVENTION

Melt reduction arc furnaces are used for the melt reduction of the iron oxide in iron ore in particular, but may be used for the melt reduction of other metal oxides.

Such a furnace is conventionally constructed substantially like an electric arc furnace used for making steel but uses an arcing electrode having a longitudinally extending passageway through which in powdered form the iron ore is fed to the working tip of the electrode. The furnace is powered by DC, the furnace hearth having means for electrically connecting the melt in the hearth to the DC power source to which the electrode is connected. The electrode is centrally positioned on the vertical axis of the furnace and if more than one such electrode is used, the electrodes are closely grouped about this axis. A highly carbonaceous iron melt is maintained in the furnace's hearth and its carbon reacts with the iron oxide of the fed ore with its consequent reduction to molten iron which continuously adds to the melt, the iron melt being withdrawn from the hearth as required to keep the melt level in the hearth from excessively increasing in height. A coke bed can be kept floating on the iron melt to maintain its carbon content and powdered carbonaceous material may be fed with the ore through the electrode or otherwise. This is a continuous process, the powdered iron oxide material being fed successively at intervals or continuously and the reaction between the iron oxide and the ore being therefore substantially continuous.

The reaction between the iron oxide and carbon continuously produces carbon monoxide gas and possibly hydrogen gas. The iron ore may be pretreated so that its iron oxide is partially reduced when fed to the furnace, but because the operation is continuous, the gases are produced in large volumes and must be continuously removed from the furnace. For this it is conventional for an electric arc furnace roof to be built with a gas outlet through which the gases are discharged.

For years an arc furnace roof has been dome-shaped and layed up from bricks with the centrally positioned electrode or electrodes using much of its area, and this has required its gas outlet to be of such small size that the gases produced by the melt reduction process pass through the outlet at such high velocity and temperature as to produce an undesirably rapid erosion of the outlet as well as of the roof brickwork, particularly around the outlet. Because the practice of the melt reduction process involves the use of a tubular electrode, normally of the graphite or Söderberg type, it is less resistant to breakage than the solid electrodes used for steel-making. For practical considerations, the periphery of the roof must be spaced a certain minimum above the hearth and its melt, and this height substantially increases at the center of the roof through which the electrode projects, because of the roof's dome shape. Consequently, the length of the tubular electrode inside of the furnace must be undesirably long considering its lowered resistance to breakage. The electrode burns off at its tip during operation, and must have a length permitting continual feeding of the electrode into the furnace. It is not unusual for the electrode to have a length in the order of 15 meters. It is expensive to make, and it is desirable to use the entire electrode length productively without loss due to breakage in the furnace.

SUMMARY OF THE INVENTION

The present invention provides a melt reduction arc furnace which is different from prior art electric furnace constructions so as to have the advantages of providing for relatively low velocity exhaust or discharge of the melt reduction gases from the furnace while reducing the length of the electrode that must operate on the inside of the furnace where it is exposed to conditions most inducive of electrode breakage.

These advantages are obtained by making the furnace roof flat so it lies in a horizontal plane with its periphery spaced as required above the hearth but with its central portion no higher although possibly slightly domed because it must be electrically insulating for the passage of the electrode and, therefore, advantageously built from magnesium bricks or the like. In this way the length of electrode projecting inside of the furnace is reduced. This flat roof has no gas outlet.

To discharge the gas, the furnace side wall has a horizontally elongated opening extending downwardly from the roof and having a threshold or gas flow dam extending upwardly from the hearth to a level above the arcing electrode's working tip. This horizontal opening can be made to extend for substantially 90° of the side wall's circumference. When the furnace is operating, upward flow of the gases is limited by the inside of the flat roof while the threshold which extends for the entire horizontal extent of the opening, limits horizontal flow of the gas below the opening. The entire furnace is otherwise made as gas-tight or impermeable to escape of the gas inside of the furnace as is possible. The result is that the gas continuously produced by the reaction between the iron oxide and carbon has a much larger exhaust flow area to pass through than ever before. The gas flow velocity is much reduced and the erosion problems correspondingly reduced. Horizontal radiation from the arc through the outlet is prevented by the threshold.

It is appreciated that there are prior art patents with schematic showings of melt reduction furnaces having flat roofs, but insofar as is shown, all actually working melt reduction furnaces have had the conventional domed roof made from bricks. One example of such patents is the Widell U.S. Pat. No. 4,146,390 assigned to the assignee of the present application and using for a schematic showing FIG. 1, illustrating a flat roof, but via its FIGS. 3 and 4 showing the actual furnace construction using the domed roof made from bricks and in which the gas outlet is built.

BRIEF DESCRIPTION OF THE DRAWINGS

The accompanying drawings are for use in connection with the following detailed description of the invention, FIG. 1 being a vertical section.

DETAILED DESCRIPTION OF THE INVENTION

Figure 1:
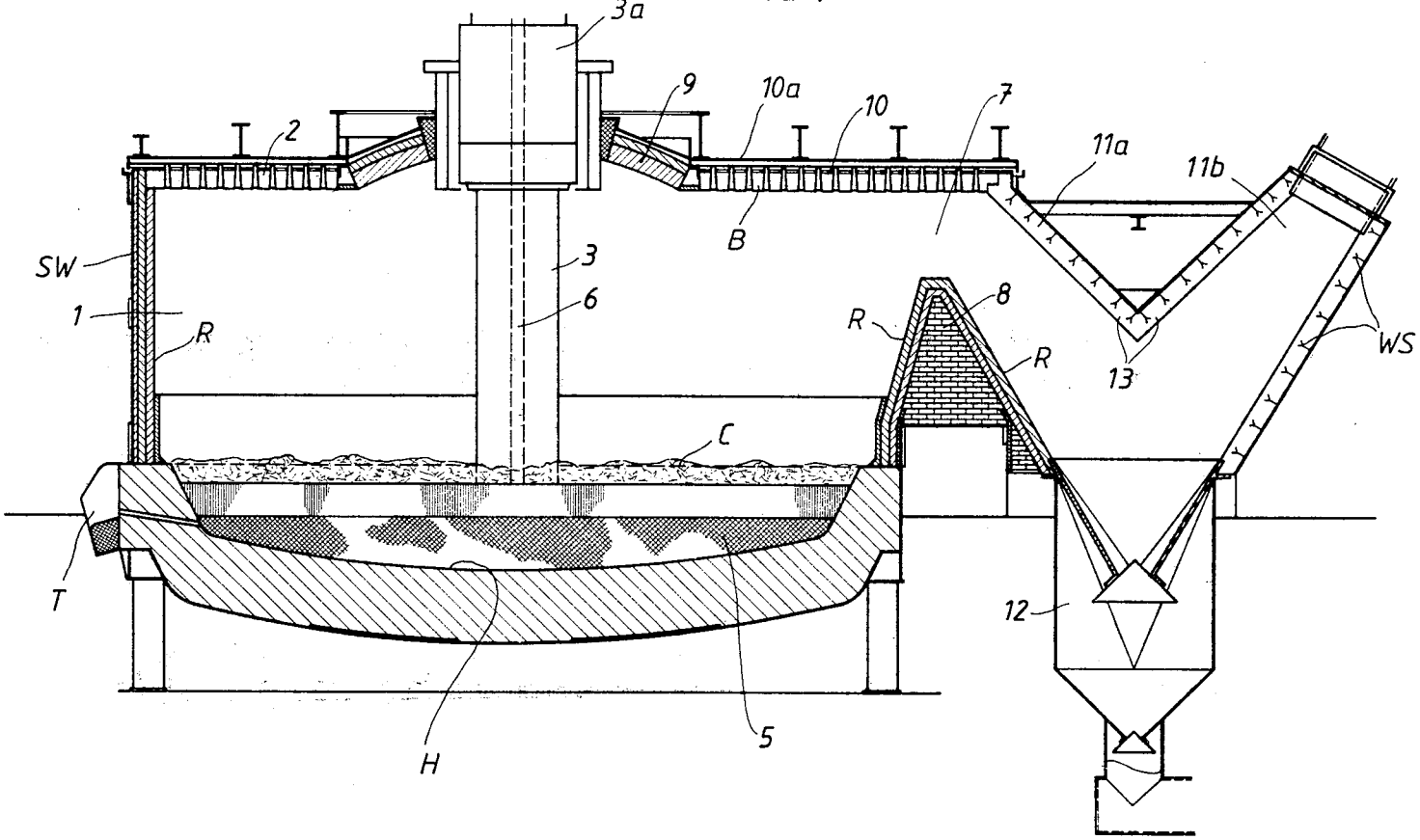

Referring to the above drawings, FIG. 1 shows the new melt reduction furnace as having its interior space 1, which contains the reaction gas, enclosed by a hearth H, a cylindrical side wall SW extending vertically upwardly from the hearth's periphery, and the flat roof 2 extending throughout a horizontal plane and closing the top of the side wall. The tubular arcing electrode 3 extends downwardly through the roof 2 on the vertical axis of the furnace. The carbonaceous iron melt 5 is shown in the hearth H and both the melt 5 and the electrode 3 are to be understood as being connected to a source of DC arcing power (not shown). Normally, the melt is operated anodically and the arcing electrode cathodically. Powered iron oxide material is fed successively or continuously through the electrode 3 via its passage 6 by the usual means (not shown) and molten iron can be successively or continuously withdrawn from the hearth H via a tapping arrangement T. Carbonaceous material C, such as coke, floats on the iron melt, the area shown between the melt and floating material indicating the possible rise and fall of the melt level. Carbonaceous material can be fed with the iron oxide through the electrode as described by the Widell U.S. Pat. No. 4,146,390.

Figure 2:
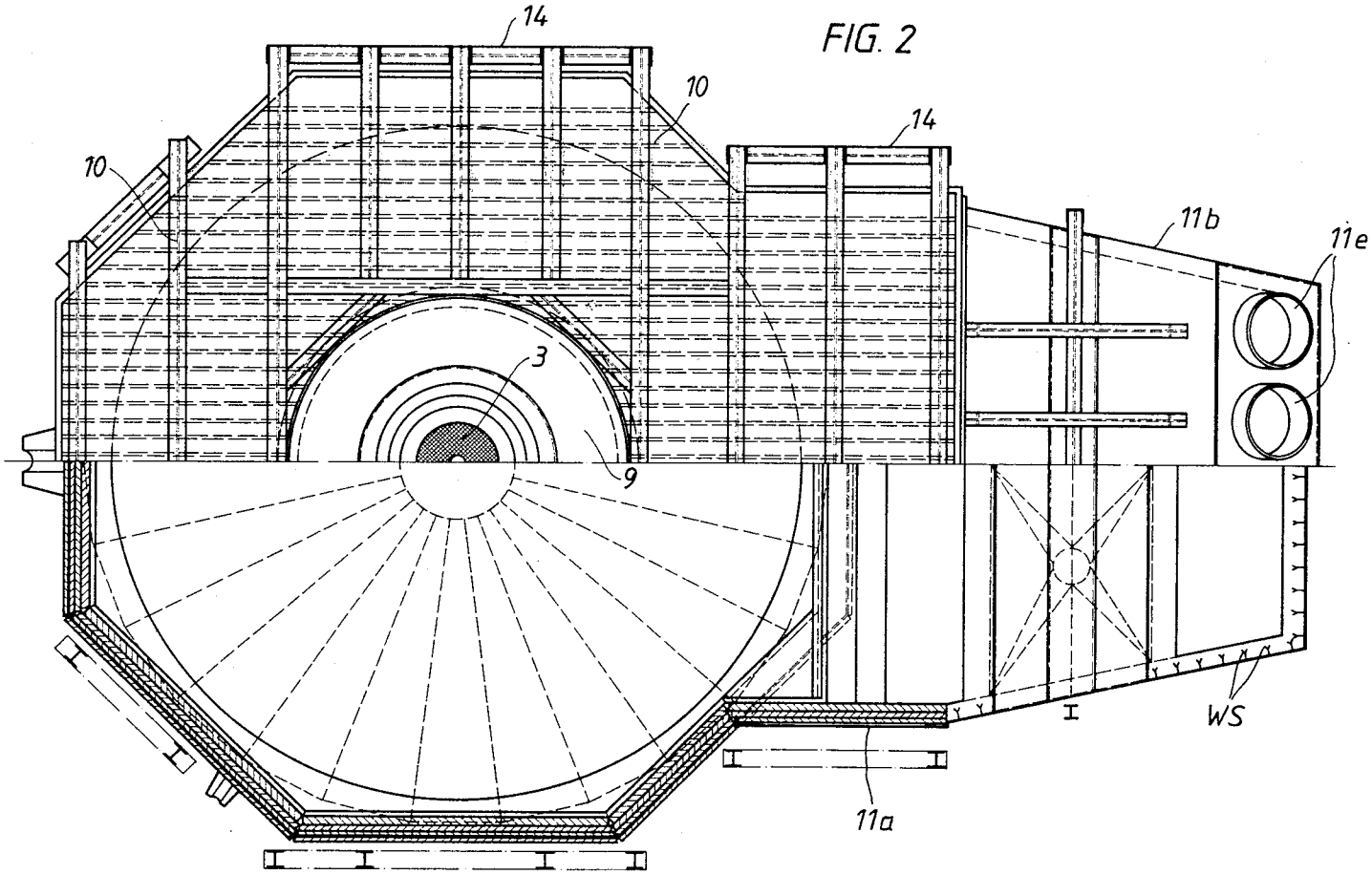
FIG. 2 a top view with one half being a horizontal section.

The side wall SW diametrically opposite to the melt tapping arrangement 4 has the horizontally elongated opening 7 extending downwardly from the roof 2 and having the threshold 8 extending upwardly from the hearth to a level substantially above the arcing electrode's working tip, a height of about two thirds of the side wall height being shown. As indicated by FIG. 2, the opening 7 can extend for as much as 90° of the side wall's circumference. The threshold can be built from bricks and lined with a refractory R as is the entire inside of the side wall SW.

Gas generated by the reaction between the iron oxide material fed through the passage 6 and the carbon of the carbonaceous melt 5 or other carbon supply keeps the furnace interior 1 filled with carbon monoxide and possible hydrogen gas under superatmospheric pressure, generated in large volumes by the melt reduction reaction. This gas which continuously increases in volume cannot flow upwardly because of the flat roof 10 which limits its upward flow, and the gas cannot flow directly horizontally because of the raised threshold 9 which extends for the full width of the opening 7, the ends of the threshold 8 joining with the furnace's side walls. The gas exhaust is via the opening 7 which because of its large cross sectional area lets the gas flow escape from the furnace at a velocity that is very much lower than results in the case of the prior art exhaust formed in the roof.

To accommodate the passage of the electrode 3 through the roof, the central portion of the flat or plane roof is made with a small dome 9 which may be constructed from magnesium bricks laid somewhat in the manner of a miniaturized conventional arc furnace brick roof. The upper surface of this brickwork can be exposed to the ambient atmosphere for cooling. This central brickwork construction 9 occupies only a relatively small part of the roof area which is otherwise completely flat. Consequently, the length of the electrode 3 projecting into and exposed to the inside of the furnace is shorter than conventional. Assuming the flat roof 2 is at its periphery spaced above the hearth a normal distance, this distance prevails substantially at the electrode exposed below its bushing 3*a* to the inside of the furnace. Typically only about 5 meters of the electrode projects in the inside of the furnace and this is in the case of a relatively large production furnace. The risk of electrode breakage inside of the furnace is substantially reduced.

This flat roof shape is possible because on its inside facing the furnace interior 1 it is made in the form of a suspended ceiling of refractory bricks B. The suspension members 10 must be metal and preferably tubular so that they can be internally water-cooled, the members all interconnecting to provide water-cooling throughout the area above the bricks. Because of such cooling possibility, the entire furnace, including its roof 2, can be and is encased by a metal plate shell 10*a* excepting for the central brickwork 9 required for the electrical insulation of the electrode 3. All gases are confined within the furnace excepting for the low velocity discharge via the elongated side wall opening 7 above the threshold 9. The brickwork 9 is free to dissipate heat via its top exposed to the ambient atmosphere. With the tubular suspension members typically spaced, they are only about 300 mm from each other, so the suspended bricks can be adequately cooled even though their top surfaces are not exposed to the ambient air.

The flat suspended ceiling of bricks can be of a conventional type but it should be provided with cooling because of the metal plate encasement of the bricks' tops.

The gas is exhausted through the elevated wide opening 7 into a gas conduit having a first section 11*a* of generally oblong cross section conforming to the opening's shape and which extends downwardly away from the opening 7 to a level below the top level of the threshold 8, the upper and lower walls of this section 11*a* diverging from each other so as to even further reduce the velocity of the gases exhausting through the opening 7. This first section 11*a* leads downwardly to a dust collector 12, the conduit having a second section 11*b* which extends upwardly from the dust collector in a gradually converging manner and which terminates with a series of exhaust pipe connections 11*c*. The side of the threshold 9 away from the furnace is lined with the refractory R, but the top of this section 11*a* and possibly its sides are hollow walls having interspaced inner and outer sides made of metal plate and their inner metal plate sides cooled throughout by water sprays WS. The inner metal plate sides, particularly those formingthe ceilings of the sections 11*a* and 11*b* and indicated at 13 in FIG. 1, may possibly be protected against erosion by a refractory lining material (not shown).

The two sections 11*a* and 11*b* form a conduit having a V-shape. As the gases descend in the conduit section 11*a*, their already relatively low velocity is further reduced by the cooling they receive via the water sprays WS on the conduit insides. The two sections at the apex of the V-shape they form provide a relatively large area and here dust possibly carried by the gas is free to drop gravitationally into the dust separator 12. During upward travel in the section 11*b*, the gas velocity does not materially increase because although this section converges, the gases are being cooled by the water sprays working against the metal insides of this section 11*b*. The gas exhausting via the pipe connections 11*c* is combustible and can be used for heating or other purposes.

The inside surface of the relatively high threshold 8 shields the gas conduit from direct arc radiation, while at the same time holding back dust that might be inadvertently produced by the force of the arc struck between the working tip of the electrode 3 and the melt 5. The arc power is sufficient to blow away slag and carbonaceous material floating on the carbonaceous iron melt 5 so that the arc is struck with a clean or naked surface of the melt, and in doing this the arc power may throw about particles of the material fed into the arc. The threshold 8 prevents the particles, or dust, from being driven directly into the opening 7, and what does pass through this opening is separated from the finally exhausting gas via the dust separator 12.

As previously described, the entire furnace is enclosed by a metal plate shell 10*a* in a gas-tight manner, excepting for the baby dome 9 which with present constructional limitations should probably be a brickwork construction. However, such a construction can be made gas-tight while providing the necessary electrical insulation isolating the electrode 3 from the metal furnace encasement.

In FIG. 2 the suspended metal refractory ceiling suspension members 10 are indicated by broken lines. The shell is supported from above by structural metal frameworks 14. The cooling water supply and manifolding of the members 10 is not illustrated because this can be done by conventional plumbing. Although not illustrated, the water exhausting from the system formed by these members 10 can be fed to the water sprays WS provided for the cooling of the manifolds top and inside inner surfaces.

I claim:

1. A melt reduction arc furnace having a hearth, a side wall extending upwardly from the hearth's periphery, a roof gas-tightly closing the top of the side wall, at least one arcing electrode extending gas-tightly downwardly through the roof, feeding means for feeding particles to be reduced directly to the tip of the electrode, and exhaust means for exhausting gas continuously fromed by melt reduction at said tip from the space under the roof within the side wall; said roof having a substantially horizontal flat bottom surface facing the hearth so as to limit upward flow of said gas and an electrically insulated central opening through which said electrode extends in a substantially gas-tight manner, and said exhaust means being formed by said side wall having a horizontally elongated opening starting at and extending downwardly from said bottom surface of the roof and having a threshold extending upwardly from the hearth to a level above the arcing electrode's said tip so as to limit horizontal flow of said gas below said opening.

2. The furnace of claim 1 in which said exhaust means further comprises a horizontally elongated gas conduit leading downwardly from said opening and then upwardly so as to have a V-shape.

3. The furnace of claim 2 in which said conduit has at least its upper side formed by a water-cooled wall.

4. The furnace of claim 2 in which said conduit has a lowermost portion at the bottom apex of the V-shape, provided with means for collecting dust.

5. The furnace of claim 1, 2, 3, or 4 in which said side wall and roof are encased by a gas-tight metal shell.

6. A melt reduction arc furnace having a hearth, a side wall extending upwardly from the hearth's periphery, a roof closing the top of the side wall, at least one arcing electrode extending downwardly through the roof, feeding means for feeding particles to be reduced to the tip of the electrode, and exhaust means for exhausting gas formed by the melt reduction from the space under the roof within the side wall in the region of the arc between electrode and melt, said roof having a substantially horizontal flat bottom surface facing the hearth so as to limit upward flow of said gas and an electrically insulated central opening through which said electrode extends in a substantially gas-tight manner, and said exhaust means being formed by said side wall having a horizontally elongated opening extending downwardly from the roof and starting close to the roof, said opening having a lower limit in the form of a threshold extending upwardly from the hearth to a level above the arcing electrode's said tip, the exhaust means running downwardly at the part directly behind the exhaust opening, thus together with the threshold preventing direct linear flow of gas out through the opening, and to limit horizontal flow of said gas below said opening.

* * * * *